US010124496B2

(12) United States Patent
Nab et al.

(10) Patent No.: US 10,124,496 B2
(45) Date of Patent: Nov. 13, 2018

(54) HAIR CLIPPING DEVICE

(71) Applicant: KONINKLIJKE PHILIPS N.V., Eindhoven (NL)

(72) Inventors: Martijn Frans Johan Nab, Eindhoven (NL); Thibault Paul Faucon, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 15 days.

(21) Appl. No.: 15/119,216

(22) PCT Filed: Feb. 23, 2015

(86) PCT No.: PCT/EP2015/053717

§ 371 (c)(1),
(2) Date: Aug. 16, 2016

(87) PCT Pub. No.: WO2015/149993

PCT Pub. Date: Oct. 8, 2015

(65) Prior Publication Data

US 2017/0008180 A1 Jan. 12, 2017

(30) Foreign Application Priority Data

Mar. 31, 2014 (EP) ..... 14162579

(51) Int. Cl.
*B26B 19/20* (2006.01)
*B26B 19/38* (2006.01)
*B26B 19/44* (2006.01)

(52) U.S. Cl.
CPC ..... *B26B 19/20* (2013.01); *B26B 19/3813* (2013.01); *B26B 19/44* (2013.01)

(58) Field of Classification Search
CPC ..... B26B 19/20; B26B 19/3813; B26B 19/44
(Continued)

(56) References Cited

U.S. PATENT DOCUMENTS 3,953,926 A 4/1976 Kallikounis
5,185,931 A 2/1993 Fujikawa et al.
(Continued)

FOREIGN PATENT DOCUMENTS

CN 203031633 U 7/2013
DE 19538730 C1 11/1996
(Continued)

*Primary Examiner* — Omar Flores Sanchez

(57) ABSTRACT

The present invention relates to a hair clipping device (10) comprising: a housing (14), a cutting assembly (16) which is arranged on a distal end (18) of said housing (14) and comprises a stationary cutting blade (22) with a stationary cutting edge (26) and a moveable cutting blade (24) with a moveable cutting edge (28), and a comb attachment (12) which is attachable to the housing (14) and comprises a first comb element (34) and a second comb element (38); wherein the first comb element (34) is configured to be arranged on a front side (36) of the housing (14) and configured to cover the stationary and the moveable cutting edge (26, 28), wherein said front side (36) runs transverse to the distal end (18) and the cutting assembly (16), and wherein the first comb element (36) comprises a plurality of first comb ribs (40) running parallel to each other and parallel to a first longitudinal direction (44) of the first comb element (34); wherein the second comb element (38) is arranged transverse to the first comb element (34) and configured to at least partly cover the distal end (18) of the housing (14), wherein the second comb element (38) comprises a plurality of second comb ribs (42) running parallel to each other and parallel to a second longitudinal direction (46) of the second comb element (38), wherein a gap size (48), which is defined as distance between two of the second comb ribs (42) measured in lateral direction (50) perpendicular to the second longitudinal direction (46), is smaller than 1 mm and wherein the second comb element (38) comprises a connection beam (68) that is arranged at a back
(Continued)

end (58) of the second comb ribs (42) opposite their free end (60) and runs parallel to the lateral direction (50); and wherein a free end (64) of the first comb ribs (40) is spaced apart from a free end (60) of the second comb ribs (42), such that a gap (66) occurs between the first and the second comb element (34, 38).

14 Claims, 5 Drawing Sheets

(58) Field of Classification Search
USPC ..... 30/133, 194, 195, 200, 201
See application file for complete search history.

(56) References Cited

U.S. PATENT DOCUMENTS

| | | | | |
|---|---|---|---|---|
| 6,079,103 | A | 6/2000 | Melton | |
| 2004/0006873 | A1 | 1/2004 | Cutting | |
| 2011/0061243 | A1 | 3/2011 | Smit | |
| 2017/0305020 | A1* | 10/2017 | Darwinkel | B26B 19/20 |

FOREIGN PATENT DOCUMENTS

| | | | |
|---|---|---|---|
| EP | 1632321 | A1 | 3/2006 |
| EP | 2105267 | A1 | 9/2009 |

* cited by examiner

HAIR CLIPPING DEVICE

This application is the U.S. National Phase application under 35 U.S.C. § 371 of International Application No. PCT/EP2015/053717, filed on Feb. 23, 2015, which claims the benefit of International Application No. 14162579.8 filed on Mar. 31, 2014. These applications are hereby incorporated by reference herein.

FIELD OF THE INVENTION

The present invention relates to a hair clipping device, in particular to a hair clipping device with a comb attachment that is attachable to the housing of the hair clipping device. The present invention further relates to the comb attachment itself.

BACKGROUND OF THE INVENTION

Electric hair cutting appliances are generally known and include trimmers, clippers and shavers, whether powered by main supplied electricity or batteries. Such devices are generally used to trim body hair, in particular facial and head hair to allow a person to have a well-groomed appearance.

Commonly, conventional devices for cutting hair comprise a main body forming an elongate housing having a front or cutting end (herein referred to as distal end) and an opposing handle end. A cutting assembly is disposed at the distal end. The cutting assembly usually comprises a stationary cutting blade with a stationary cutting edge and a moveable cutting blade with a moveable cutting edge. The moveable cutting blade moves in a reciprocal manner against the stationary cutting blade. The cutting assembly is usually fixed in a single position relative to the housing of the hair clipper, such that the orientation of the cutting assembly is determined by a user orientating the housing or main body of the hair clipping device. The stationary cutting edge and the moveable cutting edge are arranged at the tip portions of the stationary cutting blade and the moveable cutting blade, respectively. These cutting edges usually jut out of the front side of the hair clipper housing, such that the cutting edges are always visible to the user. This makes it easier for the user to see where exactly the hairs are cut, which is specifically advantageous when using the hair clipping device to form and create fine hair contours.

Since there is a great user demand for hair clipping devices that offer the possibility to be used for different hair cut lengths, many known hair clipping devices make use of separate, differently sized comb attachments. These comb attachments are generally mounted on the distal end of the hair clipping device to position the cutting assembly relative to the skin. In other words, such a comb attachment is used as a guide that moves over the skin and guides hair towards the cutting assembly. Typically, the comb attachment is mounted over the cutting assembly and spaces the cutting blades, in particular their cutting edges (the stationary cutting edge and the moveable cutting edge), apart from the surface of the skin from which the hairs extend. However, always having to replace the comb attachment by a different one when the hair cut length shall be changed might be cumbersome for the user, as this is not only time-consuming, but the user also has to store a plurality of differently sized comb attachments.

Therefore, a lot of prior art hair clipping devices use only one comb attachment that is adjustable in different positions relative to the housing of the hair clipping device. Users may thus shift the comb attachment between different positions leading to different hair cut lengths. Usually these moveable comb attachments may be adjusted between hair cut lengths of 3 mm, 5 mm, 7 mm, 9 mm, usually up to 10 mm.

An effective hair cutting performance is in most cases more difficult to guarantee when the hair clipping device is used with comb attachment as if the hair clipping device is used without comb attachment. Since such a comb attachment increases the distance of the cutting edges to the skin of the user, the hairs on the skin of the user are more difficult to reach. In other words, the comb attachment often acts as an obstacle that hinders hairs from reaching the cutting edges of the cutting assembly. Especially curled or stiff hairs therefore need to be lifted from the skin of the user in an appropriate way in order to be cut. An effective hair lifting is, however, a challenge in a lot of hair clipping devices used with comb attachments. To ensure the reachability of the hairs, the structure of the comb attachment arranged in front of the cutting edges needs to be as small as possible. This, however, limits the room for hair lifting features in the comb attachment. Also sharp features at the front section of the comb attachment, which would allow a good hair catching, are generally not acceptable as this would impact the skin-friendliness and therefore the user comfort.

Due to the above-mentioned lack of hair lifting efficiency of most of the known comb attachments, many strokes are necessary before all hairs are lifted by the comb attachment and cut by the cutting assembly. A comb attachment that would allow lifting up the hairs from their natural orientation before entering the comb and reaching to the cutting edges of the cutting assembly would therefore increase the chance that the hairs are cut to the right length and would reduce the number of strokes needed to cut all hairs.

There is thus still room for improvement.

SUMMARY OF THE INVENTION

It is an object of the present invention to provide a hair clipping device and a comb attachment for such a hair clipping device which overcome the above-mentioned problems. In particular, it is an object to provide an improved comb attachment that ensures reachability and improves hair catching and lifting, such that the hair cutting performance is improved.

According to a first aspect of the present invention, a hair clipping device is presented that comprises:

- a housing,
- a cutting assembly which is arranged on a distal end of said housing and comprises a stationary cutting blade with a stationary cutting edge and a moveable cutting blade with a moveable cutting edge, and
- a comb attachment which is attachable to the housing and comprises a first comb element and a second comb element;

wherein the first comb element is configured to be arranged on a front side of the housing and configured to cover the stationary and the moveable cutting edge, wherein said front side runs transverse to the distal end and the cutting assembly, and wherein the first comb element comprises a plurality of first comb ribs running parallel to each other and parallel to a first longitudinal direction of the first comb element;

wherein the second comb element is arranged transverse to the first comb element and configured to at least partly cover the distal end of the housing, wherein the second comb element comprises a plurality of second comb ribs running parallel to each other and parallel to a second longitudinal direction of the second comb element, wherein a gap size, which is defined as distance between two of the second comb ribs measured in lateral direction perpendicular to the second longitudinal direction, is smaller than 1 mm and wherein the second comb element comprises a connection beam that is arranged at a back end of the second comb ribs opposite their free end and runs parallel to the lateral direction; and wherein a free end of the first comb ribs is spaced apart from a free end of the second comb ribs, such that a gap occurs between the first and the second comb element.

According to a second aspect of the present invention, a comb attachment for attachment to a hair clipping device having a housing and a cutting assembly which is arranged on the distal end of said housing and comprises a stationary cutting blade with a stationary cutting edge and a movable cutting blade with a movable cutting edge is presented. The comb attachment comprises a first comb element and a second comb element. The first comb element is configured to be arranged on a front side of the housing and configured to cover the stationary and the movable cutting edge. The front side of the housing runs transverse to the distal end and the cutting assembly. The first comb element comprises a plurality of first comb ribs running parallel to each other and parallel to a first longitudinal direction of the first comb element. The second comb element is arranged transverse to the first comb element and configured to at least partly cover the distal end of the housing. Said second comb element is thus arranged at an underside of the cutting assembly, i.e. at the side of the stationary cutting blade that faces away from the movable cutting blade. The second comb element comprises a plurality of second comb ribs running parallel to each other and parallel to a second longitudinal direction of the second comb element. A gap size, which is defined as distance between two of the second comb ribs measured in lateral direction perpendicular to the second longitudinal direction, is smaller than 1 mm. The second comb element further comprises a connection beam that is arranged at a back end of the second comb ribs opposite their free end and runs parallel to the lateral direction. A free end of the first comb ribs is spaced apart from a free end of the second comb ribs, such that a gap occurs between the first and the second comb element.

Preferred embodiments of the invention are defined in the dependent claims. It shall be understood that the claimed comb attachment has similar and/or identical preferred embodiments as the claimed hair clipping device and as defined in the dependent claims.

One of the central features of the present invention relates to the technical design of the second comb element. This second comb element is configured to be arranged at the distal end of the hair clipper housing and configured to cover the backside of the stationary cutting blade, wherein said backside denotes the side of the stationary cutting blade that faces away from the moveable cutting blade. The second comb element is thus arranged substantially parallel to the stationary cutting blade when the comb attachment is attached to the housing of the hair clipping device.

The technical design of the second comb element mainly incorporates the following three features:

1. a fine-pitched comb structure, wherein the gap between two neighbouring second comb ribs is designed to be relatively small compared to comb attachments known in the art.

2. A gap that is arranged in between the first and the second comb element. The free ends of the first and the second comb element are therefore not directly connected to each other. The gap preferably runs parallel to the lateral direction and extends preferably over almost the complete width of the comb attachment measured in lateral direction.

3. The second comb element further comprises a connection beam that is arranged at the back end of the second comb ribs, i.e. at the end opposite the free end of the second comb ribs. The connection beam connects the back ends of each of the second comb ribs with each other and runs perpendicular to the second comb ribs, i.e. perpendicular to the second longitudinal direction.

The above-mentioned three features of the comb attachment cooperate together for an improved hair lifting that in turn improves the hair cutting performance. Compared to comb attachments known in the art, where such second comb ribs (comb ribs that cover the backside of the stationary cutting blade) only act as supporting surface that is used for gliding the comb attachment over the skin of the user, the herein provided second comb ribs now also act as an active hair manipulation. This works in the following way: Due to the gap provided in front of the free ends of the second comb ribs, uncut hairs may easily enter the gaps in between the second comb ribs. The fine-pitched comb structure (gap size of smaller than 1 mm) improves the combing and lifting of the uncut hairs. This is especially advantageous when curled or stiff hairs are to be cut. By stroking the comb attachment over the user's skin against the hair grain direction, i.e. against the hair line or growth direction, the hairs will be guided in the gaps between the second comb ribs and finally reach the connection beam. Due to the small gap size in-between the second comb ribs, the hairs ar already lifted during the regular stocking movement. The hairs will then hit against the connection beam at the back end of the second comb ribs. The connection beam then passes over the hairs and thereby bends them. The connection beam thus ensures that the hairs are bent completely against the grain direction, wherein the chance is increased that the hairs are standing in a more upright manner after being lifted by the second comb ribs and bent by the connection beam. These more upright standing hairs may be caught in an easier manner when stroking again over the same skin area with the comb attachment.

Experiments of the applicant have shown that the hair cutting performance is significantly improved, since the tendency that the uncut hairs may unintentionally be flattened without lifting them by the comb attachment is decreased in the above-mentioned way. Even if comparatively long hair cut lengths are desired, where the comb attachment has to have a relatively large distance to the cutting assembly, an evenly distributed hair cut length may thus be guaranteed. The hair manipulation provided by the cooperation of the above-mentioned three features has therefore been shown to be advantageous.

According to a preferred embodiment, a backside of the connection beam, which backside faces away from the distal end of the hair clipping device, is configured to touch a skin of the user during use, wherein said backside is arranged substantially coplanar with a corresponding backside of the second comb ribs.

In other words, the backside of the second comb ribs that during use faces away from the backside of the stationary cutting blade is preferably arranged substantially in the same plane with the backside of the connection beam. The term "substantially" shall herein mean that smaller plane deviations of +/− a few millimeters are possible. However, in an especially preferred embodiment the backside of the connection beam is arranged exactly coplanar with the backside of the second comb ribs. Such an arrangement of the connection beam will improve the above-mentioned bending action of the hairs that is performed by the cooperation of the second comb ribs and the connection beam. The backside of the connection beam may then contact the user's skin while stroking the comb attachment forth and back. The connection beam may thus bend the hairs against the grain direction at a very low position close to the hair roots.

The hair lifting efficiency and hair cutting performance may further be improved by appropriately dimensioning the second comb ribs of the second comb element. It is to be noted that the dimensions mentioned in the following may not be simply seen as arbitrary design choices, but result from concrete experiments of the applicant.

According to an embodiment, a height of the second comb ribs measured perpendicular to the lateral and the second longitudinal direction is at the free end of the second comb ribs smaller than 2 mm.

Such a small height at the free end of the second comb ribs facilitates to catch the hairs with the second comb element and guide them in the gaps between the second comb ribs. The height at the back end of the comb ribs may in contrast thereto be larger, such that a sufficient mechanical stability of the second comb ribs is still guaranteed. The height at the back end of the second comb ribs is preferably chosen to be in the range of 1 mm up to 5 mm.

According to a further embodiment, the free end of the second comb ribs comprises a rounded tip portion.

This rounded tip portion prevents skin irritations and increases the user comfort. In combination with the above-mentioned height dimensions, a good trade of solution is therefore found. On the one hand, the free ends are sharp enough to effectively catch the hairs in order to lift them up in the above-mentioned way. On the other hand, the rounded tip portion at the free end of each of the second comb ribs prevents that a user gets hurt.

According to a further embodiment, a pitch size, which is defined as a sum of the gap size and a width of one of the second comb ribs measured in the lateral direction, is smaller than 2 mm. Even more preferred is a pitch size of between 0.7 mm and 1.7 mm.

It is to be noted that the herein mentioned gap size and pitch size preferably refers to the size of all second comb ribs and to the size of all gaps in between two neighbouring second comb ribs. The afore-mentioned pitch size of between 0.7 mm and 1.7 mm guarantees an even distribution of the hairs, no scratching of the skin, and therefore results in no or only a few skin irritations. Considering the fact that such comb attachments usually have an overall width (measured in lateral direction) of approximately 30-50 mm, the aforementioned comparatively small pitch size leads to an overall number of more than 20 up to 30 second comb ribs running parallel to each other. This means that the comb attachment according to the present invention comprises a lot more comb ribs than a "regular" comb attachment of the prior art. Usual comb attachments normally have five up to ten comb ribs with a comparatively large gap size in between them.

According to a further embodiment, the gap size is larger than 0.2 mm and smaller than 0.8 mm. Even more preferably is a gap size between 0.3 mm and 0.6 mm. The chosen lower limit especially results from the fact that hairs may have a diameter of up to 0.2 mm.

It shall be noted that the reduction of the gap size and pitch size as taught herein for the second comb element of the newly presented comb attachment has not at all been obvious. Prior art comb attachments rather focus on comb elements with only a few comb ribs that have a comparatively large width and relatively large gaps in between them, since most of the prior art comb attachments intend to prevent an unwanted clogging effect that may result from hairs getting caught in between the comb attachment and the cutting assembly. Apart from that, thicker comb ribs with larger gaps in between them were thought to be more skin friendly and mechanically more stable. However, experiments of the applicant have shown that even comb ribs with a very small width may lead to an acceptable skin comfort, since the overall number of the second comb ribs is increased and the gaps in between them are relatively small, such that the second comb element of the comb attachment does not feel uncomfortable. The second comb ribs are apart from that more flexible compared to comb ribs of prior art comb attachments. This has also shown to be advantageous with respect to the user comfort.

According to a further embodiment, the width of the second comb ribs is larger than 0.5 mm and smaller than 1 mm. Such a small width of the second comb ribs guarantees a fairly good visibility of the cutting assembly.

According to a further embodiment, a length of the second comb ribs measured along the second longitudinal direction is smaller than or equal to 20 mm.

This upper limit for the length of the second comb ribs has ben selected, since longer comb ribs have shown to be too flexible and too instable. A length of less than 20 mm instead results in comparatively stiff comb ribs.

According to a further embodiment, the hair clipping device further comprises an adjustment mechanism for adjusting the position of the comb attachment relative to the cutting assembly.

This allows having a single comb attachment on the hair clipping device which is adjustable in length settings depending on the user's needs. The adjustment mechanism preferably allows adjusting the length settings starting at 1 mm up to 21 mm. The adjustment mechanism may either be configured to allow a length setting in predefined steps, e.g. steps of 1 mm, or to allow a stepless setting over the whole range of e.g. 1 to 21 mm.

The adjustment mechanism may be realized by two guiding rails provided on the hair clipper housing which engage with two corresponding guiding rails arranged on the comb attachment. Likewise it is also possible to realize the adjustment mechanism as a rigid-type guiding rail.

According to a further embodiment, the gap size and the pitch size of the first comb ribs of the first comb element differs from the gap and pitch size of the second comb element. The first comb element may thus have less comb ribs having dimensions which differ from the dimensions of the second comb ribs. The width and the height of the first comb ribs is preferably chosen to be larger than the width and the height of the second comb ribs.

According to a further embodiment, an angle between the first longitudinal direction of the first comb element and the second longitudinal direction of the second comb element is preferably smaller than 90°, more preferably smaller than 80°. It has been shown that an angle of less than 80° between the first comb element and the second comb element ensures that hairs can still be caught effectively and that larger angles would result in a reduction or even loss of the above-mentioned advantages lifting function of the second comb element.

According to a still further embodiment, the hair clipping device may furthermore comprise a suction unit for generating an under-pressure in an area between the cutting assembly and the comb attachment. Such a suction unit may suck in cut hairs and guide them towards the collection surface or collection chamber. In combination with the above-mentioned fine-pitched comb structure of the second comb element, this effectively presents an unwanted disposal of cut hairs, i.e. preventing cut hairs from falling out of the system.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
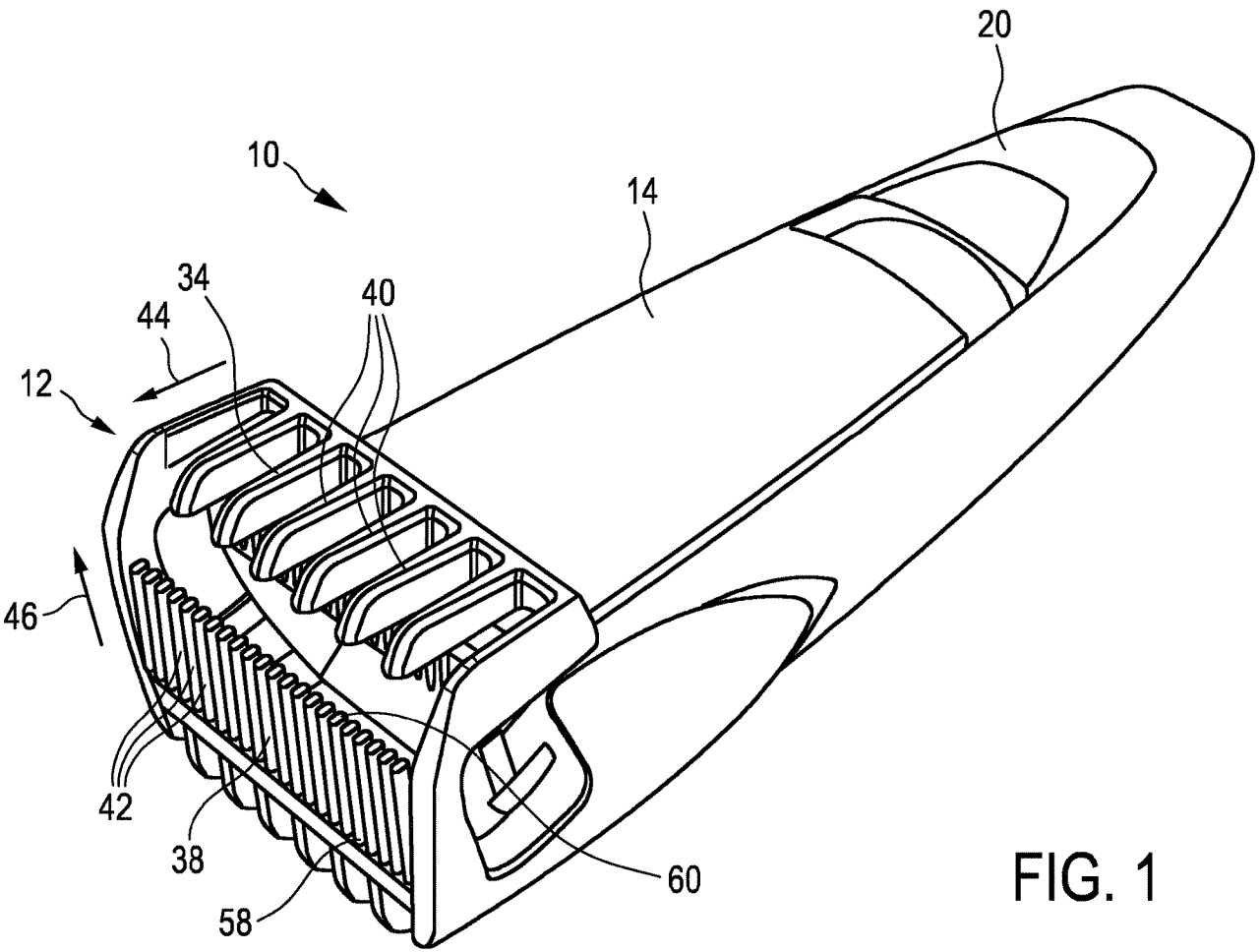
FIG. 1 shows a perspective view of an embodiment of a hair clipping device with a comb attachment according to the present invention.
Figure 2:
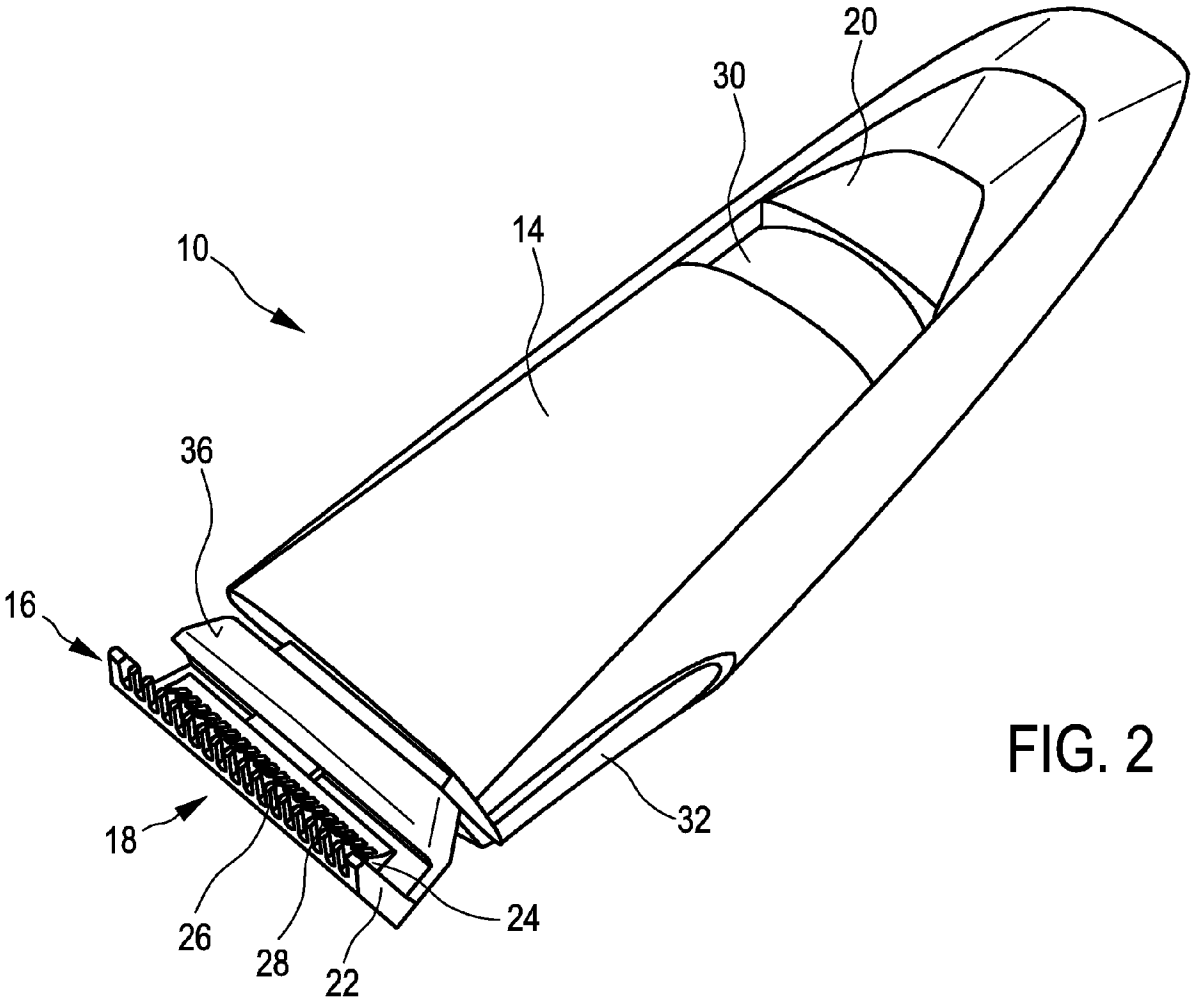
FIG. 2 shows a perspective view of the embodiment of the hair clipping device shown in FIG. 1 without the comb attachment.

FIGS. 1 and 2 show an embodiment of the hair clipping device according to the present invention with and without a comb attachment. The hair clipping device is therein in its entirety denoted with reference numeral 10.

The hair clipping device 10 comprises a comb attachment 12 which is releasably attachable to the hair clipping device 10. FIG. 1 shows the hair clipping device with the comb attachment 12, whereas FIG. 2 shows the hair clipping device 10 without the comb attachment 12.

The hair clipping device 10 comprises a housing 14 in which all remaining parts are usually integrated and to which the comb attachment 12 may be attached. The housing 14 also serves as a holder for a cutting assembly 16. The cutting assembly 16 may be releasably fixed to a distal end 18 of the housing 14. The cutting assembly 16 may, however, also be permanently fixed to the distal end 18 of the housing 14. The housing 14 is usually realized as an elongated body that forms a handle 20 at its rear end, i.e. the end opposite the distal end 18.

The cutting assembly 16 comprises a stationary cutting blade 22 and a movable cutting blade 24. The movable cutting blade 24 is in the known manner displaceably mounted on an upper surface of the stationary cutting blade 22. By the help of one or more springs (not shown), the movable cutting blade 24 is resiliently biased against the stationary cutting blade 22. The spring exerts a spring force onto the movable cutting blade 24 in order to keep the two cutting blades 22, 24 close together. Both cutting blades 22, 24 each comprise a cutting edge 26, 28 with a plurality of cutting teeth arranged in parallel to each other. The cutting edge 26 of the stationary cutting blade 22 is herein denoted as stationary cutting edge 26. The cutting edge 28 of the movable cutting blade 24 is herein denoted as movable cutting edge 28.

During operation hair cutting is performed by the interaction of the stationary cutting blade 22 and the movable cutting blade 24 that reciprocates on the stationary cutting blade 22 as this is known from other conventional hair clipping devices.

The stationary cutting blade 22 is usually designed to be thicker than the movable cutting blade 24. Said stationary cutting blade 22 is also denoted as "guard". In order to receive a good cutting performance, the movable cutting blade 24 is actively pressed onto the upper surface of the guard 22 to receive a so-called teeth pressure. This teeth pressure is, inter alia, guaranteed by the above-mentioned spring that presses the two cutting blades 22, 24 together.

A drive arrangement including a motor (not shown) is configured to drive the movable cutting blade 24 in an oscillatory manner relative to the stationary cutting blade 22. The motor itself is usually realized as an electric motor that is either powered by main supplied electricity or battery-driven.

Depending on the desired hair cut length that shall be achieved, the hair clipping device 10 may either be used with or without comb attachment 12. Especially when longer hair cut lengths are desired, the comb attachment 12 may be attached to the distal end 18 of the housing 14. As shown in FIG. 1, the comb attachment 12 is thereby mounted over the cutting assembly 16 and spaces the cutting blades 22, 24 apart from the surface of the skin of the user from which the hairs extend. It so to say acts as a spacer between the user's skin and the cutting assembly 16, so that the resulting length of the hair cut is increased compared to a usage of the hair clipping device without comb attachment 12.

The comb attachment 12 is preferably designed to be displaceable relative to the housing 14, so that different hair cut lengths may be achieved with one and the same comb attachment 12. The hair clipping device 10 thereto comprises an adjustment mechanism 30 for adjusting the position of the comb attachment 12 relative to the housing 14. The adjustment mechanism 30 comprises according to the embodiment shown in FIGS. 1 and 2 an adjustment wheel that allows shifting the comb attachment 12 by turning the adjustment wheel about a longitudinal axis of the handle 20. However, it shall be noted that the adjustment mechanism 30 may also be differently designed, e.g. by comprising a shifting bar or other types of mechanical shifting mechanisms. In the shown embodiment the comb attachment 12 is guided by two guiding rails 32 that are arranged on two opposing lateral sides of the housing 14 and two corresponding guiding rails (not shown) arranged on an inner side of the comb attachment 12. Instead of these guiding rails 32, a ratchet-type mechanism may be provided.

It is to be noted that the adjustment mechanism 30 for adjusting the position of the comb attachment 12 relative to the housing 14 may be realized in a variety of other ways. Instead of a stepless adjustment of the comb attachment 12, other adjustment mechanisms are conceivable for providing a stepwise adjustment in certain predefined steps, .e.g. in one millimeter steps.

One of the central points of the present invention relates to the structural design of the comb attachment 12. The comb attachment 12 comprises a first comb element 34 that is configured to be arranged on a front side 36 of the housing 14 and configured to cover the stationary and the movable cutting edge 26, 28 when the comb attachment 12 is attached to the housing 14 of the hair clipping device 10. It is to be noted that the front side 36 of the housing 14 shall denote the upper side of the housing 14 which runs transverse to the surface provided at the distal end 18 of the housing 14. The latter mentioned surface at the distal end 18 is arranged at the bottom side of the cutting assembly 16, i.e. at the side of the stationary cutting blade 22 that faces away from the movable cutting blade 24. In the context of this invention "transverse" shall not necessarily be understood as "perpendicular", but rather as "non-parallel".

The comb attachment 12 further comprises a second comb element 38 that is arranged transverse to the first comb element 34. This second comb element 38 is configured to at least partly cover the distal end 18 of the housing 14, i.e. to cover at least partly the bottom side of the stationary cutting blade 22.

Figure 3A:
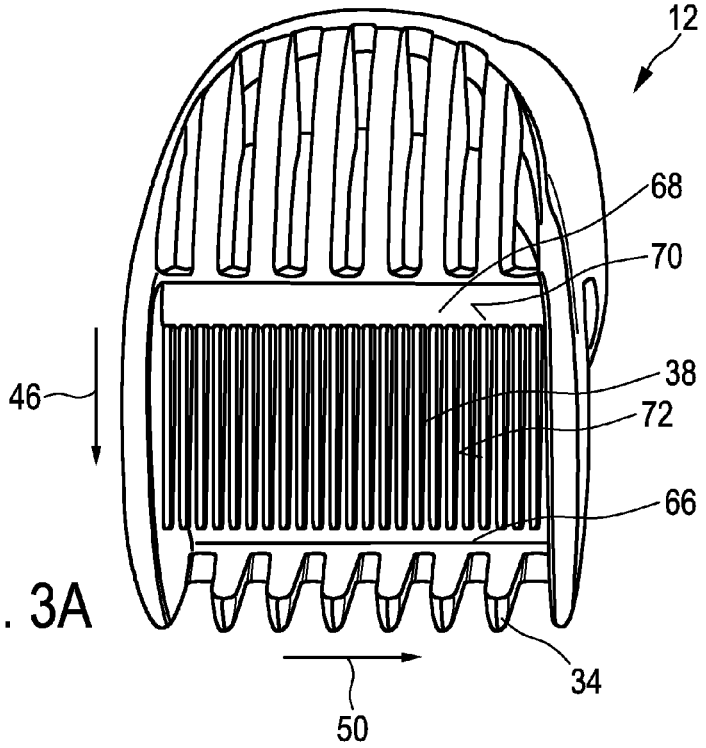
FIG. 3 shows the comb attachment from its backside in a total view (FIG. 3A) as well as in an enlarged view (FIG. 3B)
Figure 3B:
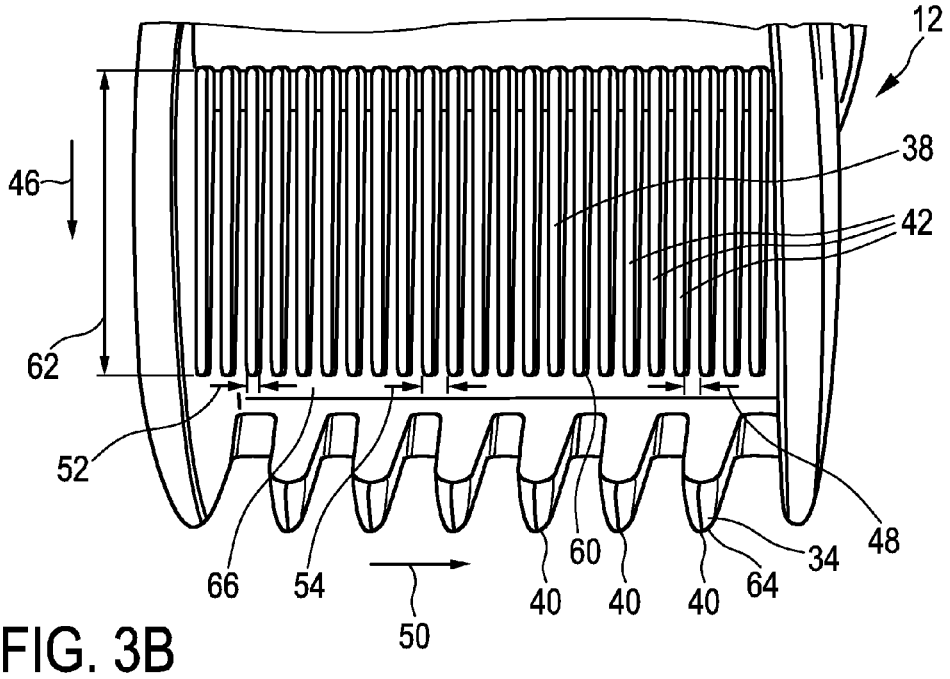

Each of the first and the second comb element 34, 38 comprises a plurality of comb ribs 40, 42 which run parallel to each other. The comb ribs 40 of the first comb element 34 are herein denoted as first comb ribs 40. The comb ribs 42 of the second comb element 38 are herein denoted as second comb ribs 42. The first comb ribs 40 are arranged parallel to a first longitudinal direction 44. The second comb ribs 42 are arranged parallel to a second longitudinal direction 46. As shown in FIG. 1, the first longitudinal direction 44 is arranged transverse to the second longitudinal direction 46. As it can be furthermore observed from the figures, in particular from FIGS. 3A and 3B, the first comb ribs 40 have different dimensions than the second comb ribs 42. The first comb ribs 40 of the first comb element 34 are preferably designed to be thicker than the second comb ribs 42 of the second comb element 38. The space between two neighboring first comb ribs 40 is preferably also larger than the space between two neighboring second comb ribs 42. In other words, the second comb element 38 comprises more comb ribs that are spaced closer to each other than the first comb element 34. The second comb element 38 comprises a very fine-pitched comb structure, whereas the first comb element 34 may comprise a "regular" comb structure as this is known from many comb attachments of the prior art. However, it shall be noted that the first comb element 34 may also comprise a similar or even the same fine-pitched comb structure as the second comb element 38.

All of the second comb ribs 42 preferably have the same dimensions. In contrast to known comb elements of the prior art, the dimensions of the second comb ribs 42 and the distances between the second comb ribs 42 are chosen to be comparatively small. A distance 48 between two neighboring second comb ribs 42 is preferably smaller than 1 mm. Said distance 48 is herein denoted as gap size. The gap size 48 is defined as distance between two neighboring second comb ribs 42 measured in lateral direction 50, wherein the lateral direction 50 is arranged perpendicular to the first and the second longitudinal directions 44, 46. It shall be noted that the mentioned gap size 48 preferably occurs between all neighboring second comb ribs 42.

A width 52 of each of the second comb ribs 42 is preferably in the range of 0.5 mm and 1 mm. Said width 52 denotes the dimension of the second comb ribs 42 measured in the lateral direction 50.

A pitch size 54, which is defined as the sum of the gap size 48 and the width 50 of one second comb rib 42, is preferably smaller than 2 mm.

Such a fine-pitched comb structure of the second comb element 38 increases the probability that curled and stiff hairs are actively caught and lifted up when the comb attachment 12 is stroked over the user's skin. In other words, the second comb element 38 provides an active manipulation also for curled and stiff hairs to lift them up from their natural orientation, such that the hair cutting performance is significantly improved in contrast to "regular" comb attachments of the prior art which usually have significantly larger gap sizes with larger comb ribs.

Comb elements of known comb attachments that are arranged at the same position as the second comb element 38 of the herein presented comb attachment 12 are usually only used as gliding elements that allow to glide or stroke the comb attachment over the user's skin. However, the herein presented fine-pitched second comb element 38 is not only used as a gliding element, but also provides an active hair manipulation. This structure will enforce that uncut hairs are lifted up as much as possible to increase the chance that the hairs will be effectively cut during the second stroke of the hair clipping device over the same area. Next to that, flat oriented and partially ingrown hairs will also be pre-combed in a more upright orientation. The fine-pitched second comb ribs 42 due to their close distancing still allow to effectively follow the skin and provide a skin-friendly contact surface.

Experiments of the applicant have led to the following preferred size dimensions of the second comb ribs 42:

The gap size 48 is preferably between 0.2 mm and 0.8 mm. The pitch size 54 is preferably between 0.7 mm and 1.7 mm. The width of the second comb ribs 42 is preferably between 0.5 mm and 1 mm.

A height 56 (see FIG. 4A) of the second comb ribs 42 is preferably between 1 mm and 5 mm, at least at a back end 58 that is opposite a free end 60 of the comb ribs 42. Said height 56 denotes the dimension of the second comb ribs 42 measured perpendicular to the second longitudinal direction 46 and the lateral direction 50. Such a small height 56 provides the advantage of an increased visibility of the cutting assembly 16, such that the cutting assembly 16 is always clearly visible to the user during use. This facilitates the handling of the hair clipping device 10 for the user. However, it shall be noted that the height 56 of each of the second comb ribs 42 is preferably even smaller than the above-mentioned range in the area at and around the tip portions at the free end 60 of the comb ribs 42. The height 56 at said free ends 60 of the second comb ribs 42 is preferably even smaller than 2 mm. This further improves the hair catching, since the hairs enter the second comb element 38 usually at these free ends 60 of the second comb ribs 42. In order to further improve the skin friendliness, the free ends 60 of the second comb ribs 42 furthermore preferably each comprise a rounded tip portion.

A length 62 of the second comb ribs 42 measured along the second longitudinal direction 46 is preferably smaller than or equal to 20 mm. Larger lengths 62 would otherwise result in too flexible and too weak comb ribs 42.

However, the above-mentioned advantageous hair lifting effect does not only result from the fine-pitched grating structure of the second comb element 38, but also from the following features which are also essential for the present invention:

The first comb ribs 40 of the first comb element 34 are not directly connected to the second comb ribs 42 of the second comb element 38. Therefore, not only each of the second comb ribs 42 comprises a free end 60, but also each of the first comb ribs 40 comprises a free end 64. This results in a gap 66 that occurs in between the first comb ribs 40 and the second comb ribs 42, in particular in between the free ends 64 of the first comb ribs 40 and the free ends 60 of the second comb ribs 42. This gap 66 extends parallel to the lateral direction 50. The gap 66 serves as entering space for uncut hairs.

A still further important feature of the second comb element 38 is the connection beam 68 that also extends parallel to the lateral direction 50 and is arranged locally behind the second comb ribs 42. This connection beam 68 connects the back end 58 of each of the second comb ribs 42 with each other. A backside 70 of the connection beam 68 during use of the comb attachment 12 faces away from the distal end 18 and is configured to touch the skin of the user when stroking the comb attachment 12 over the user's skin. Said backside 70 in other words faces away from the bottom side of the stationary cutting blade 22. The backside 70 is preferably arranged coplanar, i.e. in one and the same plane, with a corresponding backside 72 of the second comb ribs, wherein the backside 72 during use also faces away from the bottom side of the stationary cutting blade 22.

The fine-pitched grating structure of the second comb element 38, the gap 66 as well as the latter mentioned connection beam 68 cooperate together in order to catch the uncut hairs and lift them up in an efficient way. The technical principle of the cooperation of these three features is explained in the following with reference to the schematical illustration shown in FIGS. 4A and 4B.

Figure 4A:
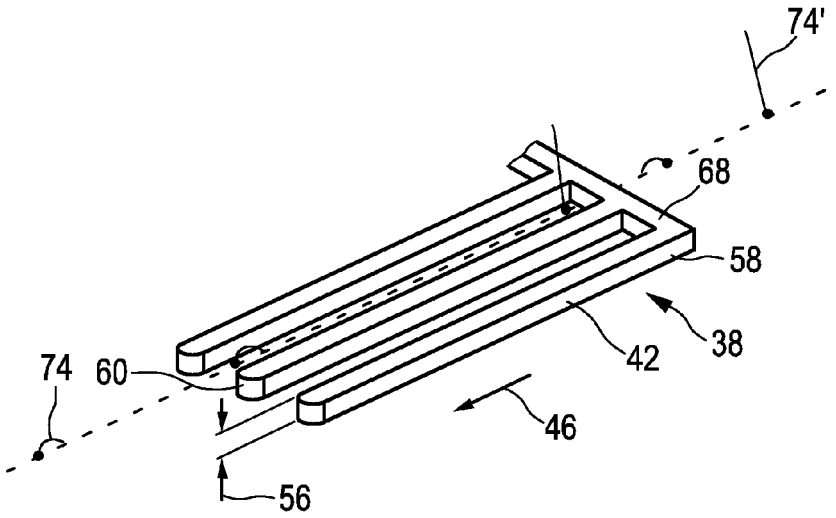
FIG. 4 schematically illustrates a function principle of the comb attachment according to the present invention in a perspective view (FIG. 4A) as well as in a sectional view (FIG. 4B)
Figure 4B:
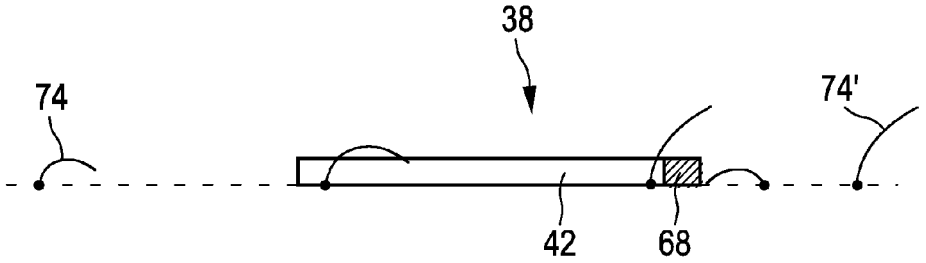

FIGS. 4A and 4B schematically illustrate how uncut hairs 74 are combed and lifted by means of the second comb element 38. The uncut hairs 74 enter the second comb element 38 at the gap 66 between the first and the second comb element 34, 38. By stroking the second comb element 38 over the user's skin, these uncut hairs 74 will then travel in between the second comb ribs 42 until they hit against the connection beam 68 arranged at the back ends 58 of the second comb ribs 42. The second comb element 38 is thereto preferably moved against the hair grain direction. The uncut hairs will already be lifted when traveling in between the second comb ribs 42. However, as soon as they hit against the connection beam 68, the hairs will be bent. By stroking the connection beam 68 over the hairs 74, each hair will then be completely bent against its grain direction, such that the hairs 74' which have passed the comb attachment 12 are arranged in a much more upright manner compared to the hairs 74 that have not yet passed the comb attachment 12. By stroking over the upright standing hairs 74' again a second time, almost all hairs 74' are cut by the cutting assembly 16 to the desired hair cut length. It shall be noted that of course a lot of hairs 74 are already cut to the desired length within the first stroke.

Figure 5A:
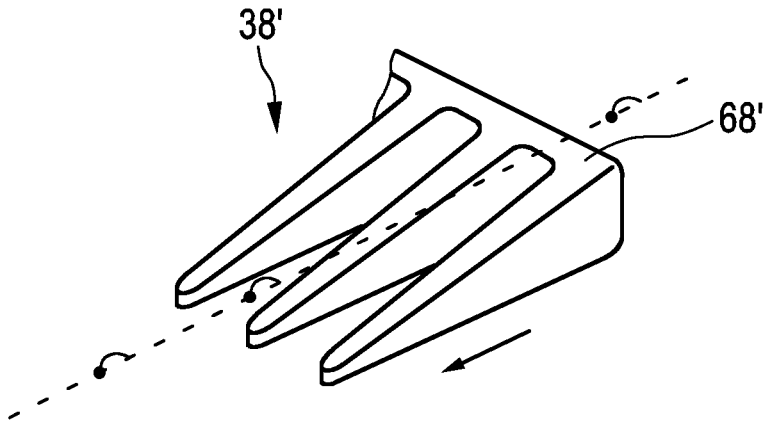
FIG. 5A (PRIOR ART)
FIG. 5 shows a function principle of a comb attachment according to the prior art in a perspective view (FIG. 5A) as well as in a sectional view (FIG. 5B).
Figure 5B:
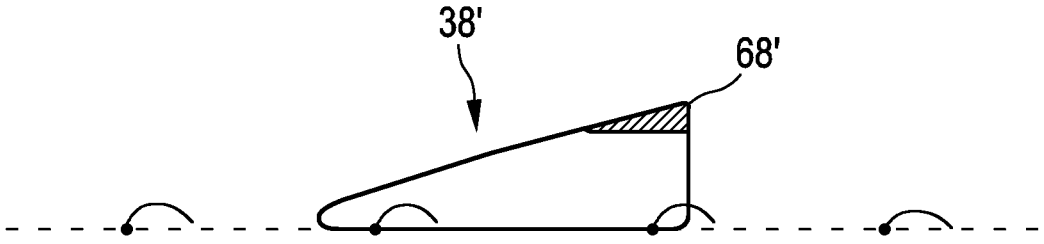
FIG. 5B (PRIOR ART)

The above-mentioned effects are usually not achieved with comb elements of the prior art. FIGS. 5A and 5B show an example of such a prior art comb element. This prior art comb element 38' more or less only serves as a gliding element that allows gliding the comb attachment over the user's skin. It does, however, not lift the hairs as efficient as the second comb element 38 according to the present invention. First of all, it usually comprises a way larger gap size in between the comb ribs. Secondly, the connection beam 68' is not configured to touch the user's skin and to thereby bend the hairs in the above-mentioned way. In contrast thereto, the connection beam 68' is usually distanced from the backside of the comb ribs, such that the hairs simply pass underneath the connection beam 68' without getting bent and reoriented.

The comb attachment 12 of the hair clipping device 10 according to the present invention thus provides compared to prior art comb attachments of this type a significantly improved hair lifting which again leads to an improved hair cutting performance.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair clipping device comprising:

a housing, a cutting assembly which is arranged on a distal end of said housing and comprises a stationary cutting blade with a stationary cutting edge and a moveable cutting blade with a moveable cutting edge, and a comb attachment which is attachable to the housing and comprises a first comb element having a plurality of first comb ribs and a second comb element having a plurality of second comb ribs;

wherein the first comb element is configured to be arranged on a front side of the housing and configured to cover the stationary and the moveable cutting edge, wherein said front side runs transverse to the distal end and the cutting assembly, and wherein the plurality of first comb ribs run parallel to each other and parallel to a first longitudinal direction of the first comb element;

wherein the plurality of second comb ribs are arranged transverse to the plurality of first comb ribs and are configured to at least partly cover the distal end of the housing, wherein the plurality of second comb ribs run parallel to each other and parallel to a second longitudinal direction of the second comb element, wherein a gap size, which is defined as distance between two of the second comb ribs measured in lateral direction perpendicular to the second longitudinal direction, is smaller than 1 mm, and wherein the second comb element comprises a connection beam that is arranged at a back end of the second comb ribs opposite their free end and runs parallel to the lateral direction; and wherein a free end of the first comb ribs is spaced apart from a free end of the second comb ribs, such that a gap occurs between the first and the second comb element.

2. The hair clipping device according to claim 1, wherein a backside of the connection beam that faces away from the distal end is configured to touch a skin of the user during use, and wherein said backside is arranged substantially coplanar with a corresponding backside of the second comb ribs.

3. The hair clipping device according to claim 1, wherein a height of the second comb ribs measured perpendicular to the lateral and the second longitudinal direction is at the free end of the second comb ribs smaller than 2 mm.

4. The hair clipping device according to claim 1, a height of the second comb ribs measured perpendicular to the lateral and the second longitudinal direction is at the back end of the second comb ribs larger than 1 mm and smaller than 5 mm.

5. The hair clipping device according to claim 1, wherein the free end of the second comb ribs comprises a rounded tip portion.

6. The hair clipping device according to claim 1, wherein a pitch size, which is defined as a sum of the gap size and a width of one of the second comb ribs measured in the lateral direction, is smaller than 2 mm.

7. The hair clipping device according to claim 6, wherein the pitch size of the second comb ribs is larger than 0.7 mm and smaller than 1.7 mm.

8. The hair clipping device according to claim 1, wherein the gap size of the second comb ribs is larger than 0.2 mm and smaller than 0.8 mm.

9. The hair clipping device according to claim 1, wherein a width of the second comb ribs is larger than 0.5 mm and smaller than 1 mm.

10. The hair clipping device according to claim 1, wherein a length of the second comb ribs measured along the second longitudinal direction is smaller than or equal to 20 mm.

11. The hair clipping device according to claim 1, further comprising an adjustment mechanism for adjusting the position of the comb attachment relative to the cutting assembly.

12. The hair clipping device according to claim 1, wherein an angle between the first longitudinal direction of the first comb element and the second longitudinal direction of the second comb element is smaller than 90°, preferably smaller than 80°.

13. The hair clipping device according to claim 1, further comprising a suction unit for generating an under-pressure in an area between the cutting assembly and the comb attachment.

14. A comb attachment for attachment to a hair clipping device having a housing and a cutting assembly which is arranged on a distal end of said housing and comprises a stationary cutting blade with a stationary cutting edge and a moveable cutting blade with a moveable cutting edge, wherein the comb attachment comprises a first comb element having a plurality of first comb ribs and a second comb element having a plurality of second comb ribs;

wherein the first comb element is configured to be arranged on a front side of the housing and configured to cover the stationary and the moveable cutting edge, wherein said front side runs transverse to the distal end and the cutting assembly, and wherein the plurality of first comb ribs run parallel to each other and parallel to a first longitudinal direction of the first comb element;

wherein the plurality of second comb ribs are arranged transverse to the plurality of first comb ribs and are configured to at least partly cover the distal end of the housing, wherein the plurality of second comb ribs run parallel to each other and parallel to a second longitudinal direction of the second comb element, wherein a gap size, which is defined as distance between two of the second comb ribs measured in lateral direction perpendicular to the second longitudinal direction, is smaller than 1 mm and wherein the second comb element comprises a connection beam that is arranged at a back end of the second comb ribs opposite their free end and runs parallel to the lateral direction; and wherein a free end of the first comb ribs is spaced apart from a free end of the second comb ribs, such that a gap occurs between the first and the second comb element.

* * * * *